US005123852A

United States Patent [19]

Gillett

[11] Patent Number: 5,123,852

[45] Date of Patent: Jun. 23, 1992

[54] MODULAR ELECTRICAL CONNECTOR

[75] Inventor: John B. Gillett, Woodstock, N.Y.

[73] Assignee: International Business Machines Corporation, Armonk, N.Y.

[21] Appl. No.: 702,258

[22] Filed: May 17, 1991

[51] Int. Cl.[5] ..... H01R 9/09

[52] U.S. Cl. ..... 439/67; 439/74; 439/496

[58] Field of Search ..... 439/67, 77, 65, 492, 439/493, 495, 496, 262, 284, 660, 74

[56] References Cited

U.S. PATENT DOCUMENTS

| | | | |
|---|---|---|---|
| 3,533,049 | 10/1967 | Thompson . | |
| 3,985,413 | 10/1976 | Evans . | |
| 4,252,390 | 2/1981 | Bowling . | |
| 4,587,596 | 5/1986 | Bunnell | 361/398 |
| 4,626,056 | 2/1986 | Andrews, Jr. et al. . | |
| 4,629,270 | 12/1986 | Andrews, Jr. et al. . | |
| 4,636,019 | 1/1987 | Gillett et al. . | |
| 4,693,529 | 9/1987 | Stillie | 439/67 |
| 4,798,541 | 1/1989 | Porter | 439/67 |
| 4,815,979 | 3/1989 | Porter | 439/493 |
| 4,902,236 | 2/1990 | Hasircoglu | 439/77 |
| 4,940,413 | 7/1990 | Childers et al. | 439/329 |
| 4,971,575 | 11/1990 | Martellotti | 439/496 |

FOREIGN PATENT DOCUMENTS

| | | | |
|---|---|---|---|
| 2129150 | 12/1971 | Fed. Rep. of Germany . | |
| 1920988 | 11/1975 | Fed. Rep. of Germany | 439/493 |
| 2813807 | 4/1979 | Fed. Rep. of Germany . | |
| 1234903 | 5/1986 | U.S.S.R. | 439/496 |

*Primary Examiner*—Neil Abrams
*Attorney, Agent, or Firm*—Robert L. Troike; Tracy-Gene G. Durkin

[57] ABSTRACT

A flexible film-type modular connector comprising a fixed block and a movable wedge-shaped block which is received within a V-shaped opening formed in the fixed block. The oblique angle at which contact is made between the fixed and movable blocks provides relative contact wipe and consistently reliable registration between the blocks while maintaining high contact normal force with low applied forces (i.e. zero insertion force). The oblique angle can be individually tailored to meet particular requirements as the connector is capable of connecting a variety of different components including cables, Printed Circuit Boards, Printed Circuit Cards, and other substrates.

14 Claims, 6 Drawing Sheets

MODULAR ELECTRICAL CONNECTOR

Technical Field

The present invention relates to a modular connector; and more particularly to a flexible film type modular connector.

BACKGROUND ART

The continuing demand for high density, high performance electrical connectors has far surpassed the capability of conventional spring contact connector technology. As a result, other sources of connector technology are rapidly emerging. Flexible film with strip lines has been shown to be a viable alternative to spring contact connectors. Flexible film connectors can provide low noise, high density connections and as such are gradually replacing spring contact connectors in various environments. However, because of the large number of contacts required and the high normal force required per contact, flexible film connectors present a problem for containing the total force needed to make consistently reliable connections. Therefore, the need exists for a flexible film connector that is capable of containing the total force required and of making consistently reliable connections.

Examples of known flexible film connectors include those described in U.S Pat. No. 4,798,541 and in its improvement U.S. Pat. No. 4,815,979 both to Porter ("the Porter patents"). The Porter patents disclose a right angle flexible circuit for making multiple electrical connections between mother and daughter printed circuit boards. The connector of the Porter patents includes a housing and an elastomeric insert which have corresponding slots to receive the daughter board. The elastomeric insert protrudes from the housing to contact the mother board. A flexible circuit surrounds the elastomeric insert making a perpendicular connection between the daughter board and the flexible circuit.

A similar connector is found in Bunnell U.S. Pat. No. 4,587,596 which wraps a flexible circuit around a housing from a mother board and into a recess formed in the housing. The daughter board is inserted into the recess to complete the connection. Stillie U.S. Pat. No. 4,693,529 also describes a mother-daughter flexible circuit connection. A flexible film surrounding a central body portion connects the boards at their intersection. Other examples of flexible circuit connectors are found in U.S. Pat. Nos. 4,626,056; 4,629,270; and 4,636,019, each of which sandwich an electrical component between a pair of opposing flexible film sheets.

Another type of a flexible circuit is that for connecting an array of vertically mounted printed circuit boards. An example of this type is found in Hasircoglu U.S. Patent No. 4,902,236. The connector of this patent includes contact tails extending from a header for receiving a flexible film folded around a spacer.

DISCLOSURE OF INVENTION

The present invention can be described as a separable electrical connector which comprises a fixed block and a moveable block. The fixed block and the moveable block each include a tapered wall which lie in parallel planes. A flexible film sheet which includes electrical contacts is disposed adjacent each tapered wall. When the fixed and moveable blocks are mated, the tapered walls approach each other at an angle to the parallel planes. A resilient member may be disposed between the fixed block and its associated film sheet and between the moveable block and its associated film sheet. The resilient member may be an actuator disposed between the moveable block and its associated film sheet and may be positionable between an open position and a closed position to provide zero insertion force. In its preferred embodiment, the tapered wall of the fixed block is a pair of tapered walls which form a V-shape, and the tapered wall of the moveable block is also a pair of walls which form a wedge-shape for mating with the V-shape of the fixed block.

One advantage of the modular connector technology of the present invention is its versatility, in that it is capable of connecting a variety of components including Printed Circuit cards (PC cards), Printed Circuit boards (PC boards), cables and substrates to similar or different components. For example, the connector is capable of mating a horizontal and a vertical component, two horizontal or two vertical components. Furthermore, the modular connector of the present invention is reliable in that it provides wiping contacts, and consistently achieves accurate registration because of the self-guiding alignment and the compliance of the moving block in all three dimensions with respect to the fixed block. In addition, the modular connector of the present invention is capable of maintaining high contact normal forces with low applied forces.

The foregoing and other objects, features and advantages of the invention will be apparent from the following more particular description of (a) preferred embodiment(s) of the invention, as illustrated in the accompanying drawing(s).

BEST MODE FOR CARRYING OUT THE INVENTION

Figure 1A:
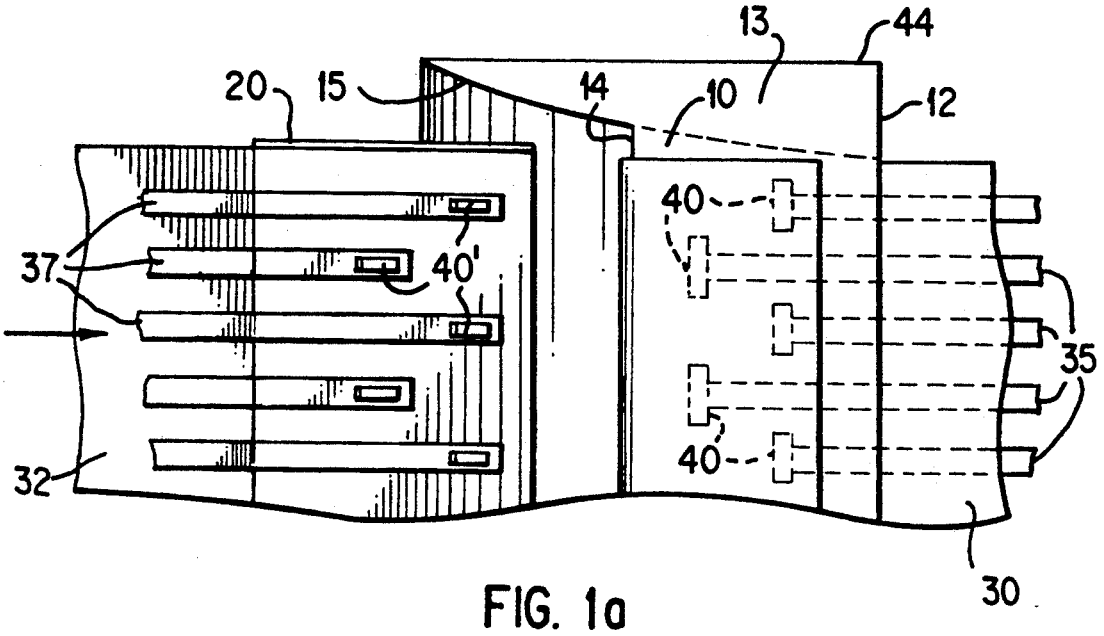
FIG. 1*a* is a partial top view of one embodiment of the modular connector of the present invention in an un-mated position.

As discussed above, the present invention provides a separable, electrical connector for connecting a variety of electrical components. Several of the many possible combinations are shown in the drawings and described below. Despite differences between the various embodiments, each includes a fixed element, a moveable element which mates with the fixed element and a pair of flexible film sheets, one attached to each of the fixed and moveable elements which contact each other to make an electrical connection between the elements.

Figure 1B:
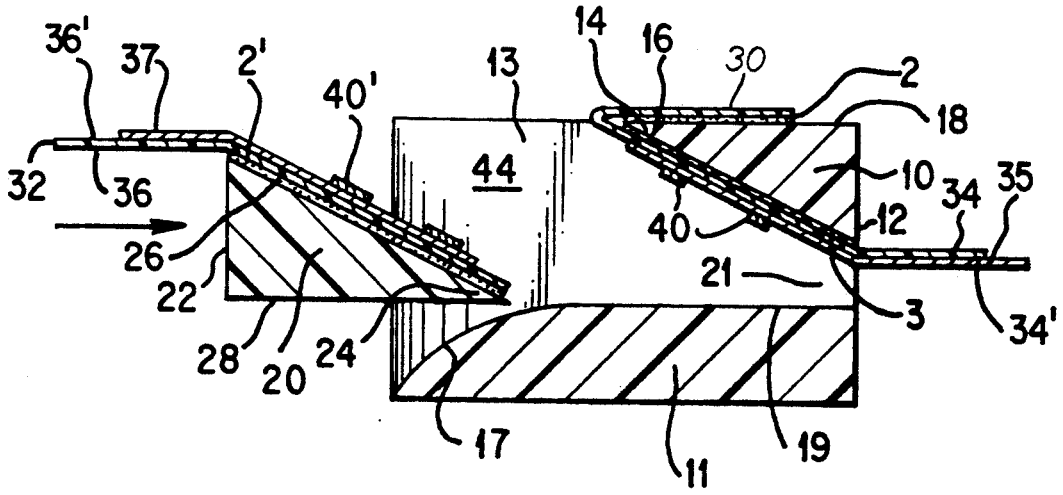
FIG. 1*b* is a cross-sectional view of the same.

With regard to FIGS. 1*a* and 1*b*, the simplest form of the present invention is shown. In this embodiment, the connector comprises a fixed block 10, a moveable block 20 and a pair of flexible film sheets 30 and 32, each of which will be described in greater detail below. FIG. 1 depicts the separable splicing of flexible film sheets 30 and 32.

Fixed block 10 is triangular-shaped and includes a base 12 and an opposing tip 14. A tapered wall 16 extends from base 12 to tip 14. A straight wall 18, which is shown perpendicular to base 12, also extends from base 12 to tip 14. Fixed block 10, floor 11 and sidewall 13 together form a housing 44 containing a slot 21 through which film 30 passes. Movable block 20 is shaped similarly to fixed block 10, with a base 22, a tip 24, a tapered wall 26 and a straight wall 28 which is shown perpendicular to base 22. Housing 44 and movable block 20 can be made of any suitable material, and preferably are made of a compressed powdered metal such as copper, molybdenum or tungsten; or of molded plastic.

The position of housing 44 is "fixed" such that it is substantially immovable with regard to block 20. The position of block 20 is "moveable" such that it can be brought into a mating arrangement with fixed block 10 along the movement of the arrow shown in FIG. 1*b*. While fixed block 10 is shown in the drawings as being arranged on top of the moveable block 20, in the alternative, the arrangement could be reversed.

Disposed on the tapered wall 16 of fixed block 10 is flexible film sheet 30. Film sheet 30 is preferably 1 to 2 mils. thick and made of a polyimide material. One surface 34 of film sheet 30 is permanently attached to fixed block 10 along wall 18 by any suitable attachment technique such as adhesive 2. Electrically conductive contacts 40 are horizontally arranged on conductive traces 35 along an opposing surface 34' of sheet 30. Raised contacts 40 are made of a conductive material deposited on traces 35. The contacts 40 are raised so as to minimize any undesirable contact with the opposing traces. In their preferred form, contacts 40 are made of a laminate of copper, covered by nickel, which is covered by gold. Although two horizontal rows of contacts are shown in the drawing figures, any number of rows that will meet the objects of the particular end use of the connector may be utilized with out departing from the scope of the invention. Between surface 34 of film 30 and the surface of wall 16 of block 10, a resilient member or interposer 3 is bonded to one or both surfaces. Interposer 3 may be 2 to 3 mils of adhesive, or a thin sheet of silicone elastomer or similar material.

The function of the resilient member 3 is to deform enough to accommodate any irregularities in the relative heights of the contacts 40 and 40', and to provide relative contact wipe while deforming under the forces caused by the motion of block 20 toward block 10 after initial contact has been made between contacts 40 and 40'. This wiping action removes dust and other undesirable material from the contacts to ensure that a reliable connection is made.

Disposed on tapered wall 26 of movable block 20 is flexible film sheet 32. One surface 36 of film sheet 32 is attached to block 20 by an adhesive 2'. Film sheet 32 is similar in configuration and construction to film sheet 30. However, conductive contacts 40' are deposited in a vertical arrangement on traces 37 on opposing surface 36' of sheet 32. The horizonal and vertical arrangement of the contacts provides the greatest target area for contact mating. This affords the greatest tolerance for misalignment of blocks 10 and 20. While a horizontal/-vertical arrangement of contacts 40 and 40' is preferred, contacts 40 and 40' can be arranged at any angle to each other and still provide the necessary connection between electrical traces 35 and 37 on films 30 and 32.

In operation, block 20 is brought towards block 10 such that tip 24 and wall 28 may ride up a guide ramp 17 to slide along surface 19 of floor 11 until contacts 40 and 40' engage. A similar guiding action is provided horizontally by the tapered guide ramp 15 of housing 44, to ensure that the contacts are correctly registered with each other before mating.

Figure 2:
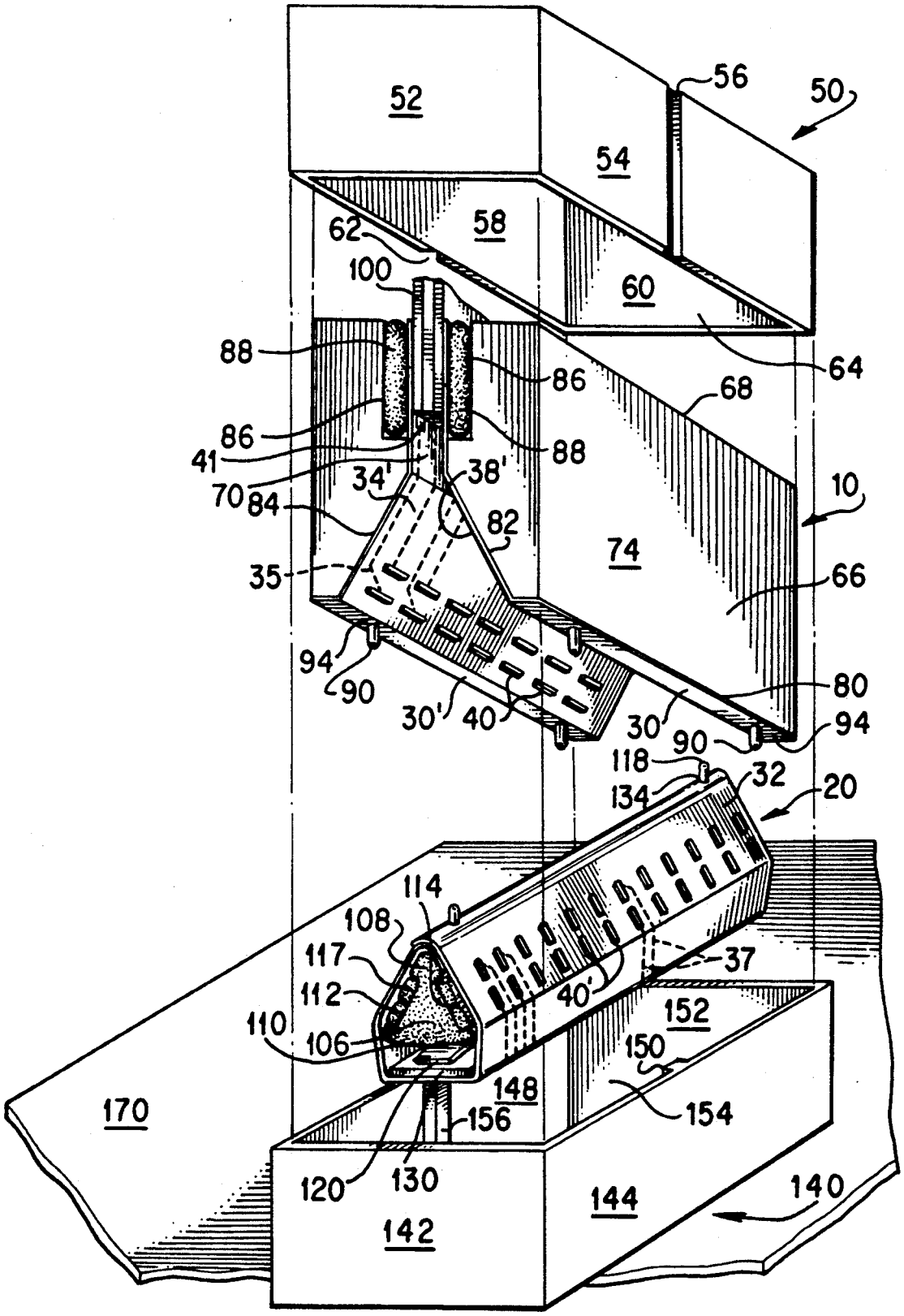
FIG. 2 is an exploded view of a further embodiment of the modular connector of the present invention.
Figure 3:
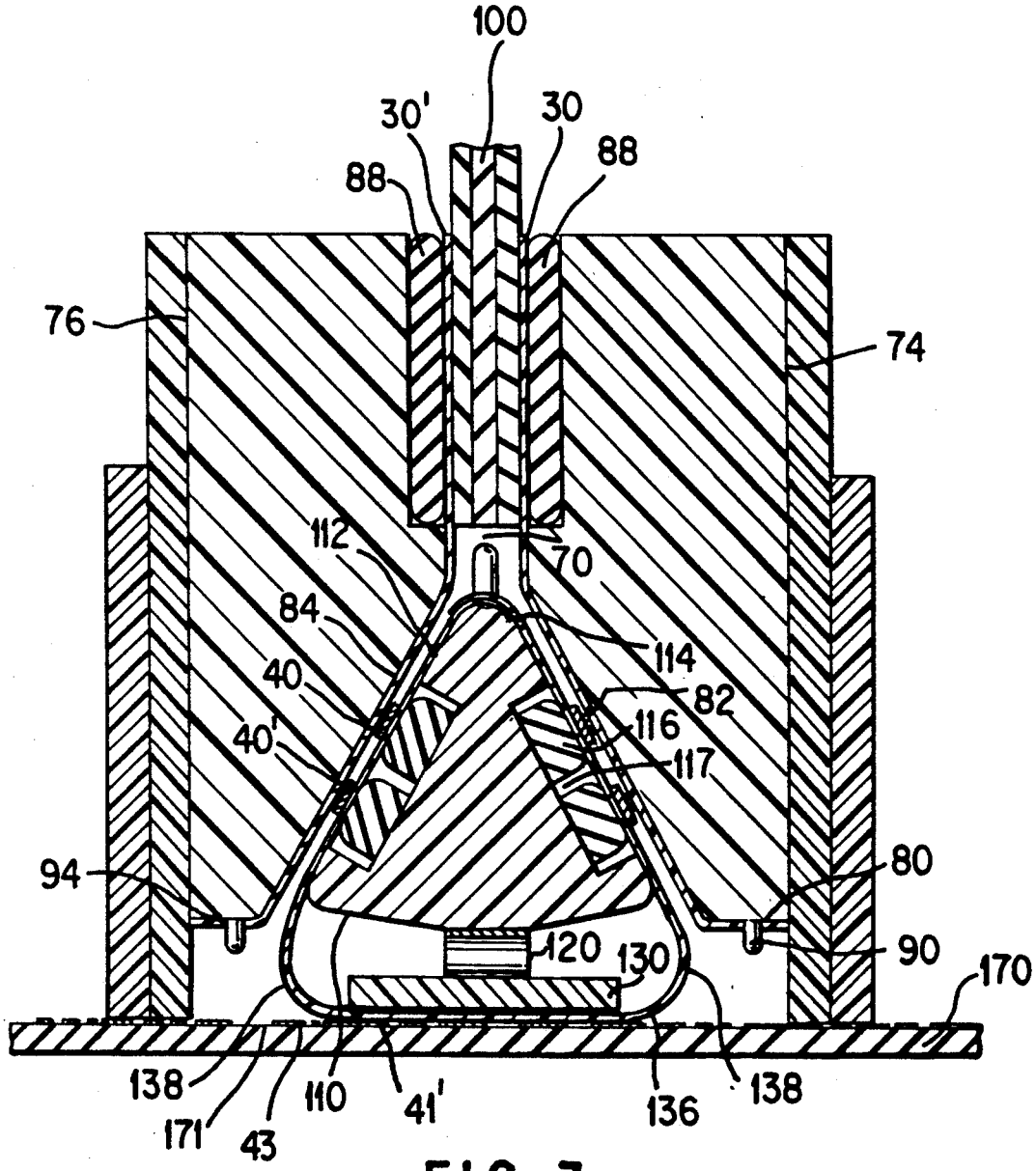
FIG. 3 is a cross-sectional view of the connector of FIG. 2 when mated.

FIGS. 2 and 3 in the drawings illustrate the connector of the present invention in the form of a module used to mate the edge of a conventional "daughter" PC card 100 with a conventional "mother" PC board 170. This perpendicular arrangement of electrical components (PC board and PC card) typically occurs in the personal computer and mainframe computer environments. Although just one module is shown, it is expected that a row of three or four such modules would be provided to connect one PC card to one PC board. This arrangement minimizes the accumulated tolerances along the entire system.

FIG. 2 shows an exploded view of the components which make up a single module of the present invention. As in the embodiment of the present invention shown in FIGS. 1*a* and 1*b*, the embodiment of FIGS. 2 and 3 includes three basic elements: a fixed block 10, a moveable block 20 and a pair of flexible film sheets 30(30') and 32. Beginning with the top and bottom of FIG. 2 and working toward the center of the drawing, an inner housing 50 and an outer housing 140 are shown. Inner housing 50 includes a front wall 52, a right side wall 54, a left side wall 58, and a rear wall 60. Walls 52, 54, 58, and 60 define an inner chamber 64 in which the fixed block 10, moveable block 20 and flex films 30(30') and 32 are received (See FIG. 3).

Outer housing 140 similarly includes a front wall 142, a right side wall 144, a left side wall 148, and a rear wall 152. Walls 142, 144, 148 and 152 define an inner chamber 154 which receives inner housing 50 (See FIG. 3). Alignment grooves 56 and 62 are provided on the exterior surface of walls 54 and 58, respectively. Similarly, alignment tabs 150 and 156 are provided on the interior surface of walls 144 and 148, respectively. When housings 50 and 140 are mated, tab 150 is received within groove 56 and tab 156 is received within groove 62 to ensure proper alignment of the housings.

Fixed block 10 includes a body portion 66 which is generally V-shaped and includes a top surface 68 with an aperture 70 therethrough for insertion of daughter board 100. Fixed block body 66 further includes a right side wall 74 and an opposing left side wall 76 (See FIG. 3). The front wall of fixed block 66 is cutaway to reveal aperture 70 and a pair of tapered inner walls 82 and 84 which form a V-shape in the bottom surface 80 of the block body 66. To ensure that daughter board 100 will be adequately received within aperture 70, resilient members 88 may be may provided in grooves 86 formed along a portion of aperture 70. Resilient members 88 may be formed of an elastomeric material, and preferably are formed of silicone.

A pair of first flexible film sheets 30 and 30' are provided along the tapered inner walls 82 and 84 of fixed block body 66. First film sheet 30 is provided along wall 82 from bottom surface 80 to and through aperture 70. Second film sheet 30' is provided along tapered wall 84 from bottom surface 80 to and through aperture 70. Apertures 94 are provided along the bottom end margin of film sheets 30 and 30' for receipt of alignment pins 90 extending from the bottom surface 80 of fixed block body 66. Pins 90 are preferably formed integral with fixed block body 66. In the alternative, pins 90 may be formed separately and affixed to block body 66 by any suitable means.

Flexible film sheets 30 and 30' include contacts 40 similar to those described above with regard to the embodiment of the present invention illustrated in FIGS. 1*a* and 1*b*. In order to make electrical connection between contacts 40 and PC card 100, conductor pads 41, preferably made of copper, are provided along the surface 34' and 38' of each film sheet where it contacts card 100 (card 100 is cut away in FIG. 2 to expose one such pad 41). Conductive traces 35 (shown in dotted lines) connect pads 41 with contacts 40.

Movable block 20 includes a wedge-shaped body 106, a resilient member or actuator 120 and a base plate 130, each of which will now be individually described. Wedge-shaped body 106 includes a narrow tip 108 and an opposing wide base 110. The left side wall 112 and right side wall 114 taper from base 110 to tip 108. Grooves 117 are formed in walls 112 and 114 and receive resilient members or interposers 116 formed of an elastomeric material (preferably silicone) which compresses (See FIG. 3) when fixed block 10 and movable block 20 are mated. Preferably, resilient members 116 are individual columns (similar to the surface of a ping pong paddle), with one such column located behind each contact 40' provided on the outer surface of a second flexible film sheet 32 which surrounds movable block 20. In the alternative, or in addition, similar resilient elements could be provided in recesses formed along tapered inner walls 82 and 84 of fixed block body 66, behind contacts 40. The provision of resilient elements between the contacts and the block assists in the wiping action between the contacts during mating of the blocks. As best seen in FIG. 3, when fixed block 10 and movable block 20 are mated, resilient columns 116 and actuator 120 (described in detail below) are compressed, causing film 32 to bulge or buckle along its sides as at 138.

Resilient actuator 120 is provided between the base 110 of wedge-shaped body 106 and base plate 130. FIGS. 2 and 3 illustrate a leaf spring (an inverted, elongated U-shape) which extends substantially the full length of base 110 and biases body 106 away from base plate 130. Although a leaf spring is shown in this embodiment, the preferred mode of biasing body 106 is with a series of independent elastomeric columns which extend the length of base 110 (See FIG. 5, for example). The columns may be formed of any suitable resilient material such as silicone. In the alternative, a canted coil spring or a buckling beam spring could be used. Furthermore, where zero insertion force is desired, a linear or rotary cam could be used, as could a thermal actuator such as a shape retention alloy, or a pneumatic or hydraulic member (See the description of FIGS. 6*a* and 6*b* below).

Base plate 130 is of a generally rectangular shape which follows the profile of base 110 of body 106. Plate 130 is preferably made of the same material as mother board 170 in order to match the thermal characteristics between the two and thereby reduce the overall stress on the electrical connections. In the alternative, where matching thermal properties is not important, a compression spring, such as a buckling beam spring could be used and the base of the spring could serve as the base plate.

Second flexible film sheet 32, similar in construction and configuration to sheets 30 and 30' discussed above, wraps around movable block 20, beginning and ending at tip 108. Alignment pins 118, similar to pins 90 above, may be provided along tip 108 for receiving alignment apertures 134 formed in the ends of film sheet 32. Rather than pins 90 and 118, film sheets 30(30') and 32 could be attached to block bodies 66 and 106, respectively by any suitable means such as welding, soldering or adhesive, for example.

Sheet 32 includes contacts 40' which are arranged vertically. As with the embodiment of the invention illustrated in FIGS. 1*a* and 1*b*, this horizontal/vertical arrangement of contacts 40 and 40' maximizes the target area. Wiping action between the contacts can be tailored by adjusting the relative angles of contacts 40 and 40'. Conductive traces 37 (shown in dotted lines) connect contacts 40' to conductive pads 41' provided on the bottom surface 136 of film sheet 32 (See FIG. 3). Similar conductive pads 43 are provided on the top surface 171 of mother board 170 for contacting pads 41'.

Figure 4:
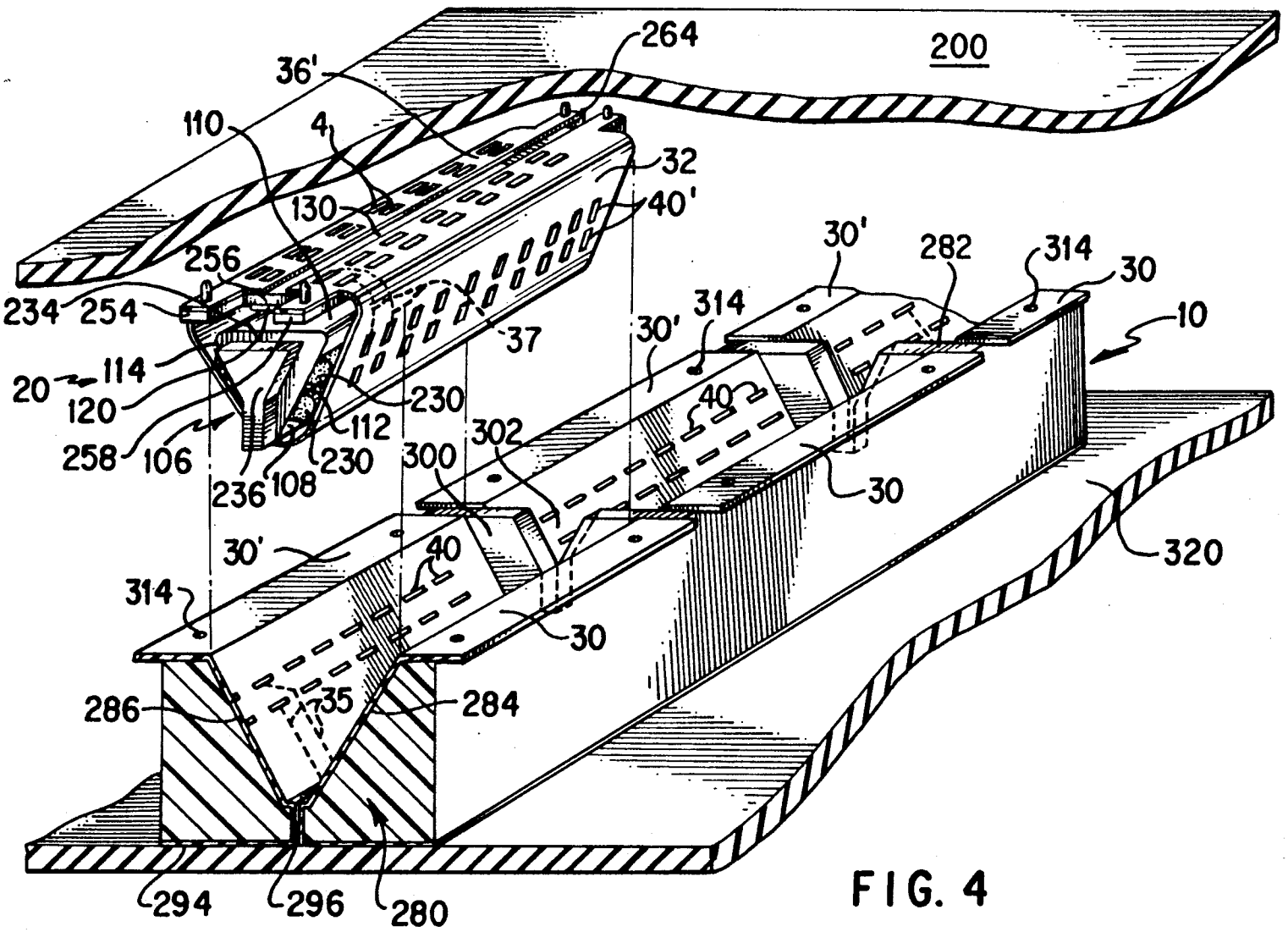
FIG. 4 is an exploded view of another embodiment of the modular connector of the present invention.

Turning now to FIG. 4, a connector for an area array is illustrated. In this embodiment, the connector of the present invention is used to electrically connect a substrate 200 to a PC board 320. It should be appreciated that the positions of PC board 320 and substrate 200 can be reversed, that is, PC board 320 can be on top of substrate 200. As in the previously described embodiments, the connector of the present invention comprises three main components, a fixed block 10, a movable block 20, and flexible film sheets 30 (30') and 32, each of which will now be described in greater detail.

Movable block 20 is generally similar in configuration and construction to the movable block of the embodiment of FIGS. 2 and 3 described above. That is, movable block 20 includes a wedge-shaped body 106, a resilient actuator 120 and a base plate 130, all of which are wrapped in a flexible film sheet 32. Movable block body 20 includes a narrow tip 108 and a wide base 110. Tapered side walls 112 and 114 extend between base 110 and tip 108. Log-like resilient members or interposers 230 extend along the length of tapered side walls 112 and 114 from a front end 234 to an opposing rear end (not shown). Resilient members or interposers 230 bias film sheet 32 away from block body 106. A wedge shaped guide post 236 is provided on front end 234 and on the rear end (not shown) of block body 106. Post 236 mates with an aperture 302 formed in a guide buttress 300 on fixed block 10 (described in detail below).

Resilient actuator 120 is shown in the drawings as a leaf spring similar to that shown in FIGS. 2 and 3. However, any of the alternatives mentioned above may be substituted for the leaf spring in this embodiment as well. Actuator 120 resiliently biases body 106 away from base plate 130. Base plate 130 is similar to that shown in FIGS. 2 and 3, however, it further includes a left front extension 254 and a right front extension 258 which define a recess 256 therebetween. Recess 256 is compatible with a central rear extension 264. Extension 264 in one base plate is received within recess 256 in an adjacent base plate when a plurality of movable blocks are inter-fit with one another in an array.

Flexible film sheet 32 is similar to that described above. However, in this embodiment, sheet 32 wraps around the movable block 20 from the wide end or base of wedge-shaped body 106. As in the previous embodiment, conductive pads 4, preferably made of copper, are deposited on the surface 36' of flexible film sheet 32. Pads 4 provide electrical contact with substrate 200. Conductive traces 37 (shown in dotted line) are also provided on film sheet 32 to provide an electrical connection between pads 4 and vertical contacts 40' deposited on the surface 36' of sheet 32.

Fixed block 10 is similar in configuration and construction to fixed block 10 described above with regard to FIGS. 2 and 3, however, it is inverted. That is, block 10 includes a body 280 that is generally V-shaped. Body 280 includes a top wall 282 and tapered inner walls 284 and 286 which form the V-shape. Opposite top wall 282 is a bottom wall 294 which includes an aperture or slot 296. FIG. 4 shows portions of three fixed blocks in an array. As mentioned briefly above, between each fixed block is a guide buttress 300 with a slot 302 formed therein. Slot 302 mates with guide post 236 formed on front end 234 and the rear end of movable block body 20. This mating of post 236 and slot 302 assists in the alignment of each individual movable block as it mates with its associated fixed block.

A pair of flexible film sheets 30 and 30', similar to those described above with regard to FIGS. 2 and 3 are provided along the tapered inner walls 284 and 286 of each fixed block body 280. Sheets 30 and 30' may be welded as at 314 to the top surface 282 of block body 280, and extend to and through aperture 296 formed in bottom wall 294. Conductive pads (not shown), as described above with regard to previous embodiments, are provided on the exposed surfaces of film sheets 30 and 30' which contact PC board 320. Conductive traces 35 (shown in dotted lines) are provided between horizontal contacts 40 and the conductive pads to complete the connection between the film sheets 30, 30' and PC board 320.

Figure 5:
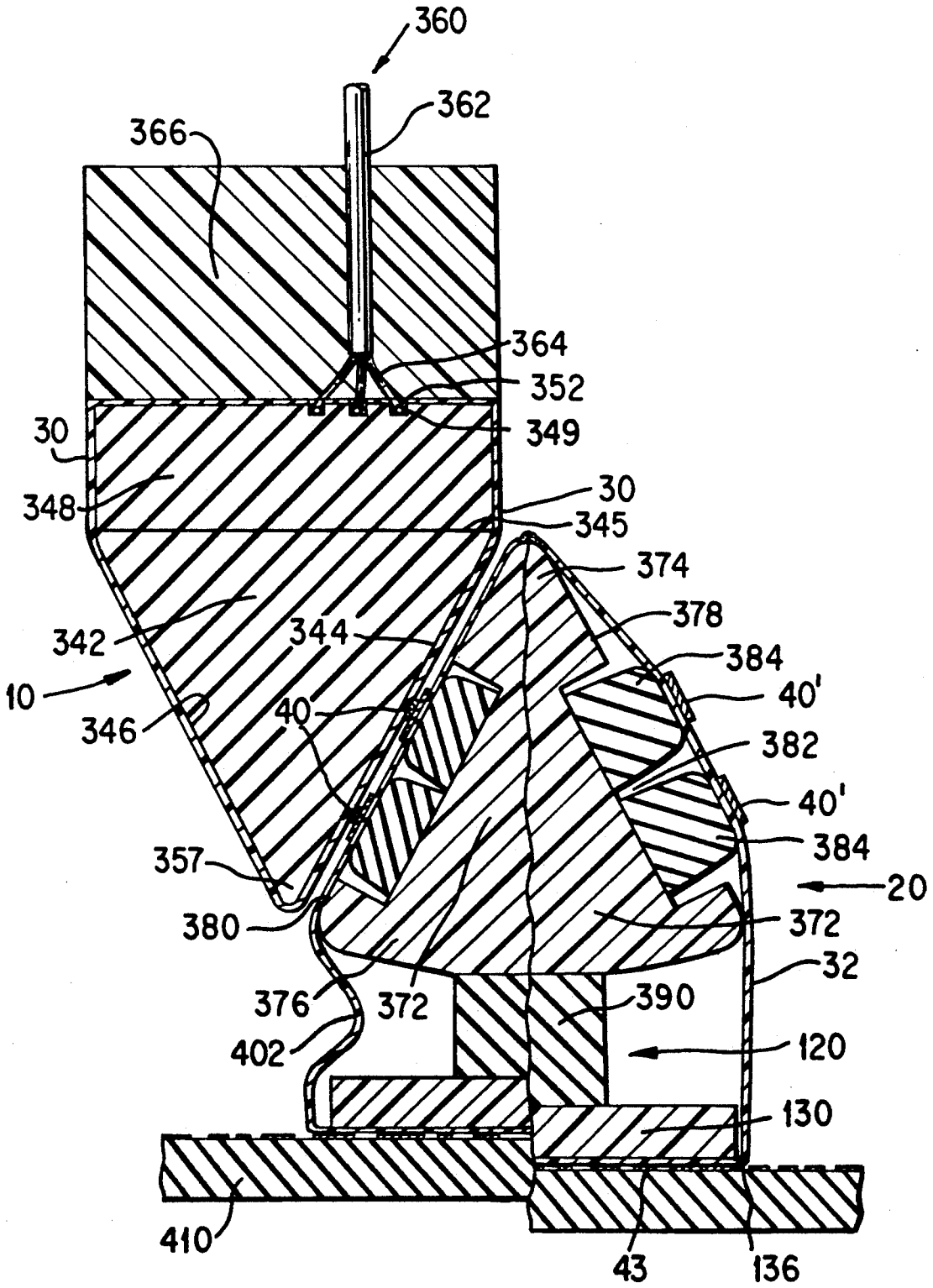
FIG. 5 is yet another embodiment of the modular connector of the present invention.

FIG. 5 illustrates yet a further embodiment of the present invention used to connect a cable 360 with a PC board 410. On the left hand side of the drawing, the connector is shown in its mated position; on the right hand side of the drawing, the connector is shown in its un-mated position. As in the previously-described embodiments of the present invention, the connector comprises three core components, a fixed block 10, a movable block 20 and flexible film sheets 30 and 32, each of which will now be described in greater detail. Although a single fixed block 10 is shown in the drawing figure, it should be understood that a second fixed block would likely be disposed adjacent block 10 in similar contact with movable block 20.

Fixed block 10 comprises a wedge-shaped body 342 and a support 348. Body 342 has tapered sides 344 and 346 which extend between a wide base 345 and a narrow tip 357. Support 348, preferably rectangular shaped in cross-section and formed of a resilient elastomeric material, is disposed adjacent base 345. A flexible film sheet 30 is disposed around fixed block body 342 and support 348 and is attached thereto in any suitable manner such as by adhesive. Apertures 352 are provided in film sheet 30 adjacent support 348. Preferably, apertures 352 are reinforced with conductive "eyelets" (preferably copper) which also assist in attaching cable 360 to support 348. In particular, recesses 349 are provided in support 348 in alignment with apertures 352 formed in film sheet 30. Wires 364 of cable 360, which are exposed from casing 362, are threaded through apertures 352 in film sheet 30 and are soldered to the eyelets. Conductive traces (similar to those discussed above with regard to element 35 but not shown here) are provided between the eyelets and horizontal contacts 40 provided on sheet 30. A strain relief member 366 is provided to support cable 360. In practice, many cables would be connected in this manner to film sheet 30. Member 366 is preferably molded in situ of plastic or resin material.

Movable block 20 is similar to that described above with regard to the previous embodiments. Block 20 is comprised of a body 372, a resilient actuator 120 and a base plate 130 all of which is surrounded by a flexible film sheet 32. Body 372 is also wedge-shaped and includes a narrow tip 374, a wide base 376 and tapered side walls 378 and 380 extending between tip 374 and base 376. Recesses 382 are formed in tapered side walls 378 and 380. Resilient members or interposers in the form of elastomeric columns 384 (similar to columns 116 described above) are disposed within recesses 382 behind contacts 40' disposed on the surface of flexible film sheet 32. Furthermore, conductive traces (similar to those discussed above) are provided between contacts 40' and the bottom surface 136 of sheet 32 which contacts conductive pads 43 on PC board 410.

Resilient actuator 120 in this embodiment is a series or row of elastomeric columns 390 provided to bias base 376 away from base plate 130. Columns 390 may be made of any suitable resilient, elastomeric material and preferably are made of silicone. Although an elastomeric column is shown in this drawing figure, the alternatives discussed above with regard to actuator 120 may also be utilized in this embodiment. Base plate 130 is similar in configuration and construction to that described above. As shown in the left hand side or mated position of the connector of FIG. 5, resilient members 384 and 390 are compressed by the application of force from fixed block 10. This compression causes flexible film 32 to buckle, as at 402.

Figure 6A:
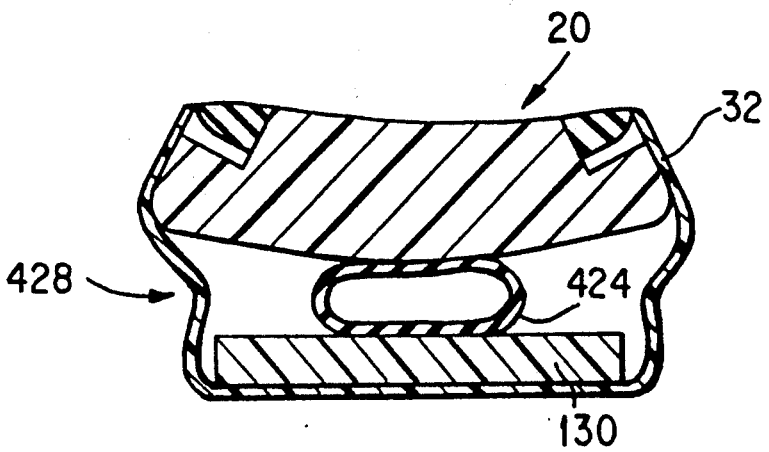
FIG. 6*a* is a partial view of a further embodiment of the modular connector of the present invention in an un-mated position.
Figure 6B:
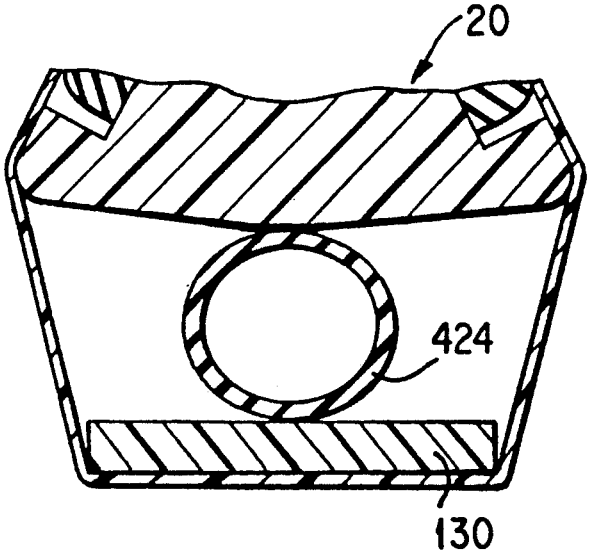
FIG. 6*b* is a view similar to FIG. 6*a* with the connector in a mated position.

FIGS. 6*a* and 6*b* illustrate an embodiment of the connector of the present invention in which the force on the electrical component during insertion is zero (commonly referred to as zero insertion force or ZIF). In this embodiment, rather than biasing the movable block and the base plate with a resilient actuator, the actuator can be used to mechanically urge the movable block into and out of contact with a fixed block. One means for accomplishing ZIF is to provide a bladder 424 between the movable block 20 and the base plate 130. By inflating the bladder with a fluid such as liquid or gas, the diameter can be increased (as in FIG. 6*b*) or decreased (as in FIG. 6*a*) to raise or lower the movable block 20 into and out of contact with a fixed block (not shown). As in the previously described embodiments, the flexible film sheet 32 (which is similar in all respects to the flexible film sheets described in defail above) will buckle, as at 428, when the bladder 424 is in the deflated or open position.

In general, each of the above-described embodiments of the present invention operate similarly. The fixed block is held stationary with regard to the movable block as the vertical contacts on the flexible film disposed on the movable block are brought into contact with the horizontal contacts on the flexible film disposed on the fixed block. As a result of the mating walls of the movable and fixed blocks being tapered, the contacts are mated neither parallel to each other nor perpendicular to each other. The advantage of this oblique contact angle is that the horizontal and vertical forces on the connector are less that the contact forces. Furthermore, the contact angle can be individually tailored to optimize the necessary force to ensure proper contact. In addition, the horizontal and vertical contact arrangement provides the necessary wipe to ensure a reliable contact. As a result of the resilience of the actuator, the movable block is compliant in three directions 1) away from the base plate; 2) across the base plate (transversely); and 3) along the base plate (longitudinally). This allows the movable block to self align when mating with the fixed block. That is, the forces on both of the tapered walls of the movable block body are equalized which increases the reliability of contact. Furthermore, the contact forces are balanced with the spring force which reduces the overall insertion force required.

While the invention has been particularly shown and described with reference to the preferred embodiments thereof, it will be understood by those skilled in the art that the foregoing and other changes in form and details may be made therein without departing from the spirit and scope of the invention.

Having thus described our invention, what we claim as new and desire to secure by Letters Patent is:

1. A separable electrical connector comprising:

a fixed block including a tapered wall;

a first flexible film sheet including electrical contacts thereon, disposed adjacent said tapered wall of said fixed block;

a movable block including a tapered wall corresponding to the tapered wall of said fixed block for mating with said fixed block, said tapered walls lying in parallel planes and approaching each other at an angle to said planes when said fixed block and said movable block are mated;

a second flexible film sheet having contacts thereon disposed adjacent said tapered side of said movable block for engagement with said electrical contacts on said first flexible film sheet when said movable block is mated with said fixed block;

a resilient member disposed between one of said fixed block and said movable block and its associated flexible film sheet;

said movable block being wedge-shaped having a wide base, a narrow tip and a second tapered wall forming a pair of tapered walls with said first tapered wall; and said resilient member being disposed between said base of said movable block and said second flexible film sheet.

2. A connector as set forth in claim 1, wherein the position of said resilient member during mating of said fixed block and said movable block is movable between an open position wherein said first flexible film sheet disposed on said movable block is out of engagement with said first flexible film sheet disposed on said fixed block, and a closed position wherein said second flexible film sheet disposed on said movable block is in engagement with said first flexible film sheet disposed on said fixed block to provide zero insertion force.

3. A connector as set forth in claim 1, further comprising:

a base plate and wherein said resilient member biases said movable block away from said base plate.

4. A separable electrical connector comprising:

a generally V-shaped fixed block including a pair of tapered walls forming said V-shape;

a first flexible film sheet including electrical contacts thereon, disposed adjacent said tapered wall of said fixed block;

a movable block including a tapered wall corresponding to the tapered wall of said fixed block for mating with said fixed block, said tapered walls lying in parallel planes and approaching each other at an angle to said planes when said fixed block and said movable block are mated;

a second flexible film sheet having contacts thereon disposed adjacent said tapered side of said movable block for engagement with said electrical contacts on said first flexible film sheet when said movable block is mated with said fixed block;

a resilient member disposed between one of said fixed block and said movable block and its associated flexible film sheet;

said movable block being wedge-shaped having a wide base, a narrow tip and a second tapered wall forming a pair of tapered walls with said first tapered wall;

an inner housing in which said fixed block is received; and an outer housing in which said movable block is received wherein said inner housing and said outer housing mate to form a module encasing said fixed block and said movable block.

5. A separable electrical connector comprising:

a generally V-shaped fixed block including a pair of tapered walls forming said V-shape;

a first flexible film sheet including electrical contacts thereon, disposed adjacent said tapered wall of said fixed block;

a movable block including a tapered wall corresponding to the tapered wall of said fixed block for mating with said fixed block, said tapered walls lying in parallel planes and approaching each other at an angle to said planes when said fixed block and said movable block are mated;

a second flexible film sheet having contacts thereon disposed adjacent said tapered side of said movable block for engagement with said electrical contacts on said first flexible film sheet when said movable block is mated with said fixed block;

a resilient member disposed between one of said fixed block and said movable block and its associated flexible film sheet;

said movable block being wedge-shaped having a wide base, a narrow tip and a second tapered wall forming a pair of tapered walls with said first tapered wall; and said fixed block further includes an aperture formed therein and said first flexible film sheet being a pair of flexible film sheets extending on opposite tapering walls of said fixed block, each film of said pair of film sheets extending through said aperture.

6. A connector as set forth in claim 5, further comprising a printed circuit card disposed within said opening and sandwiched between said pair of films.

7. A connector as set forth in claim 5, further comprising a printed circuit board in electrical contact with said pair of first flexible film sheets disposed on said fixed block, and a substrate in electrical contact with said second film sheet disposed on said movable block.

8. A connector as set forth in claim 5, wherein said fixed block is provided in an array such that a plurality of fixed blocks receive a plurality of movable blocks.

9. A separable electrical connector comprising:

a fixed block including a tapered wall;

a first flexible film sheet including electrical contacts thereon, disposed adjacent said tapered wall of said fixed block;

a movable block including a tapered wall corresponding to the tapered wall of said fixed block for mating with said fixed block, said tapered walls lying in parallel planes and approaching each other at an angle to said planes when said fixed block and said movable block are mated;

a second flexible film sheet having contacts thereon disposed adjacent said tapered side of said movable block for engagement with said electrical contacts on said first flexible film sheet when said movable block is mated with said fixed block;

a resilient member disposed between one of said fixed block and said movable block and its associated flexible film sheet;

said movable block being wedge-shaped having a side base, a narrow tip and a second tapered wall forming a pair of tapered walls with said first tapered wall;

said fixed block comprises:

a pair of fixed wedge-shaped blocks each one of said pair of fixed wedge-shaped blocks having a wide base and a narrow tip, said pair of fixed wedge-shaped blocks disposed side by side with said wide base of each one of said pair of fixed wedge-shaped blocks disposed adjacent one another, wherein said movable block is received between said narrow tips of an adjacent pair of said fixed wedge-shaped blocks; and said first flexible film sheet comprises a pair of flexible film sheets, one film of said pair of films extending from said base to said tip of one of said pair of fixed wedge-shaped blocks, the other one film of said pair of films extending from said base to said tip of the other of said pair of fixed blocks.

10. A connector as set forth in claim 9, further comprising apertures formed in said first flexible film at said base of said pair of fixed blocks for receiving electrical wires from a cable.

11. A reusable, separable electrical connector comprising: at least one generally v-shaped fixed block having at least one pair of tapered planar walls forming said v-shape; a first flexible film sheet including electrical contacts thereon disposed adjacent said tapered planar walls of said fixed block;

a movable block having at least one symmetrical wedge-shaped body having a wide base, an opposite narrow tip and first and second tapered planar walls between said tip and opposite ends of said base complementing said fixed v-shaped block for mating thereto, said tapered walls of said fixed and movable blocks lying in parallel planes when said movable block and fixed block are mated;

a second flexible film sheet having contacts thereon disposed adjacent said tapered walls of said movable block for engagement with said electrical contacts on said first flexible film sheet when said movable block is mated with said fixed block; and a resilient member disposed between said wedge-shaped body and said second flexible film sheet.

12. A connector as set forth in claim 11, wherein said resilient member is disposed between said pair of tapered walls of said movable block and said second flexible film sheet.

13. A connector as set forth in claim 11, wherein said fixed block comprises:

a pair of fixed wedge-shaped blocks each one of said pair of fixed wedge-shaped blocks having a wide base and a narrow tip, said pair of fixed wedge-shaped blocks disposed side by side with said wide base of each one of said pair of fixed wedge-shaped blocks disposed adjacent one another, wherein said movable block is received between said narrow tips of an adjacent pair of said fixed wedge-shaped blocks.

14. A connector as set forth in claim 11, wherein said contacts on said first flexible film sheet are disposed perpendicular to said contacts disposed on said second flexible film sheet.

* * * * *